US008695502B2

(12) United States Patent
Peles et al.

(10) Patent No.: US 8,695,502 B2
(45) Date of Patent: Apr. 15, 2014

(54) CLEANING STATION

(75) Inventors: Moshe Peles, Lapid (IL); Michael Melnik, Rehovot (IL); Dror Kella, Nes-Ziona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1164 days.

(21) Appl. No.: 12/416,285

(22) Filed: Apr. 1, 2009

(65) Prior Publication Data

US 2010/0251916 A1 Oct. 7, 2010

(51) Int. Cl.
*B41F 35/00* (2006.01)

(52) U.S. Cl.
USPC ..... 101/425; 101/424

(58) Field of Classification Search
USPC ..... 101/425; 401/218
See application file for complete search history.

(56) References Cited

U.S. PATENT DOCUMENTS

| | | | | |
|---|---|---|---|---|
| 4,311,780 | A * | 1/1982 | Mochizuki et al. | 430/119.7 |
| 4,436,054 | A * | 3/1984 | Ceelen et al. | 399/348 |
| 5,521,685 | A | 5/1996 | Barnes et al. | |
| 5,596,398 | A * | 1/1997 | Woo et al. | 399/346 |
| 5,854,962 | A | 12/1998 | Boockholdt et al. | |
| 5,999,778 | A * | 12/1999 | Chang et al. | 399/237 |
| 7,010,259 | B2 | 3/2006 | Gila et al. | |
| 7,991,343 | B2 * | 8/2011 | Izawa et al. | 399/349 |
| 2004/0234309 | A1 * | 11/2004 | Nagata et al. | 399/348 |

OTHER PUBLICATIONS

Rosen, Marta; "Ribbing instability Non Newton Effects"; Aug. 2007; PASI; Mar del Plata, Argentina; http://m.njit.edu/~kondic/pasi/files/Rosen/rosen-rodillos.ppt.

* cited by examiner

*Primary Examiner* — Anthony Nguyen

(57) ABSTRACT

A cleaning station includes a fluid input which introduces a passive flow of fluid into a trough and a slit which provides an outlet through which the fluid exits the trough. A wetting roller rotates in a cylindrical cavity to form a viscous fluid pump which draws the fluid through the slit to form a fluid film on an outer surface of the wetting roller.

10 Claims, 8 Drawing Sheets

CLEANING STATION

BACKGROUND

During the operation of a digital Liquid Electro Printing (LEP) system, ink images are formed on the surface of a photo-imaging cylinder. These ink images are transferred to a heated offset roller and then to a print medium, such as a sheet of paper. The photo-imaging cylinder continues to rotate, passing through various stations to form the next image. A cleaning station cleans stray particles and cools the photo-imaging cylinder surface by placing an oil film on the surface with a wetting roller. Subsequently, a sponge roller lifts the oil film from the cylinder surface along with stray particulates and other contaminants.

The oil film produced by the wetting roller should be very uniform across the surface of the photo-imaging cylinder. Spatial or temporal variations in the film thickness can result in uneven cooling and cleaning of the photo-imaging cylinder surface. This, in turn, can produce variations in print quality. For example, higher temperature areas of the cylinder surface may react differently than cooler areas during photocharging, ink deposition, or the transfer of the ink image. Further, areas of the surface that receive less oil may retain stray ink particles from the previous image.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
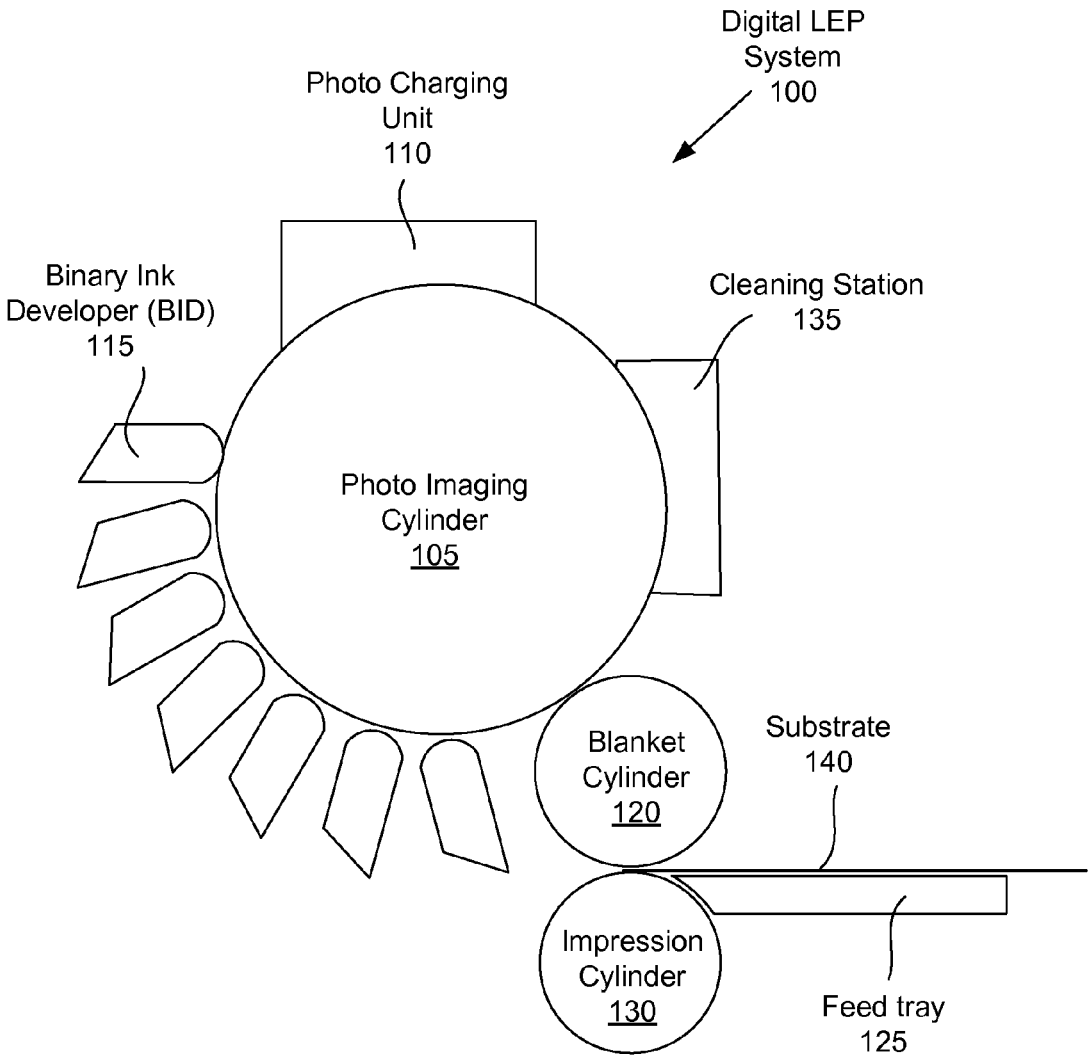
FIG. 1 is a diagram of an illustrative digital LEP system, according to one embodiment of principles described herein.

Digital printing refers to a printing process in which a printed image is created directly from digital data. In contrast to non-digital printing processes, the words, pages, text and images are created electronically with, for example, word processing or desktop publishing programs, and printed by a digital printer without any intermediate steps such as film processing, image setting, plate mounting, registration, etc. Because digital printers do not require any manual configuration between print jobs, digital printers are capable of printing different images on each sheet of print media. This versatility makes digital printers well suited to shorter print runs and specialized printing tasks.

The term "electrostatically printing" refers to a process of printing whereby a colorant or other material is arranged into a pattern or a layer defined by an electric field. This can occur by passing a colorant or other material through an electric field and onto an electrostatic surface. One example of electrostatic printing is the Liquid Electro Printing process.

The term "Liquid Electro Printing" or "LEP" refers to a process of printing in which a liquid toner is applied through an electric field onto a surface to form an electrostatic pattern. In most LEP processes, this pattern is then transferred to at least one intermediate surface, and then to a print medium. The term "liquid electro printer" refers to a printer capable of LEP. Liquid toner is also commonly referred to as ink in the art of LEP printing.

During the operation of a digital LEP system, ink images are formed on the surface of a photo-imaging cylinder. These ink images are transferred to a heated offset roller and then to a print medium. The photo-imaging cylinder continues to rotate, passing through various stations to form the next image. A cleaning station cleans stray particles and cools the surface of the photo-imaging cylinder by applying an oil film with a wetting roller to the surface of the photo-imaging cylinder. Subsequently, a sponge roller lifts the oil film from the cylinder surface along with stray particulates and other contaminants.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

As used herein and in the appended claims, a "passive" oil or fluid flow is a flow in which the kinetic energy and directionality of the flow are disrupted or dissipated using, for example, a number of baffles, holes, slits, channels, chambers, and other features.

FIG. 1 is a diagram of one illustrative embodiment of a digital LEP system (100). The desired image is initially formed on the photo-imaging cylinder (105), transferred to the blanket cylinder (120) (also called an offset cylinder), and then transferred to the print medium (140). The desired image is communicated to the printing system (100) in digital form. The desired image may include any combination of text, graphics and images.

According to one illustrative embodiment, an image is formed on the photo-imaging cylinder (105) by rotating a clean, bare segment of the photo-imaging cylinder (105) under the photo charging unit (110). The photo charging unit (110) includes a corona wire and a laser imaging portion. A uniform static charge is deposited on the photo-imaging cylinder (105) by the corona wire of the photo charging unit (110). As the photo-imaging cylinder (105) continues to rotate, it passes the laser imaging portion of the photo charging unit (110). A number of diode lasers dissipate the static charges in selected portions of the image area to leave an invisible electrostatic charge pattern that represents the image to be printed.

Ink is transferred onto the photo-imaging cylinder (105) by Binary Ink Developer (BID) units (115). There is one BID unit (115) for each ink color. During printing, the appropriate BID unit is engaged with the photo-imaging cylinder (105). The engaged BID unit presents a uniform film of ink to the photo-imaging cylinder (105). The ink contains electrically charged pigment particles which are attracted to the opposing electrical fields on the image areas of the photo-imaging cylinder (105). The ink is repelled from the uncharged, non-image areas. The photo-imaging cylinder (105) now has a single color ink image on its surface.

According to one illustrative embodiment, the photo-imaging cylinder (105) continues to rotate and transfers the ink image to a blanket cylinder (120). As will be further described below, this process may be repeated for each of the color planes to be included in the final image.

The process of transferring the ink image from its origin on the photo-imaging cylinder (105) is called "offset printing." The offset printing method has several advantages. First, the offset process protects the photo-imaging cylinder (105) from wear which would occur if the sheet of print medium (140) was to directly contact the photo-imaging cylinder (105). Second, the blanket cylinder (120) is covered with a renewable rubber blanket. This rubber blanket compensates for any unevenness in the surface of the print medium (140) and deposits ink uniformly into the bottom of any depressions or grain. Consequently, the illustrative digital LEP system can print on a very wide range of print media having different surfaces, textures, and thicknesses.

The print medium (140) enters the printing system (100) from the right, passes over a feed tray (125), and is wrapped onto the impression cylinder (130). As the print medium (140) contacts the blanket cylinder (120), the single color ink image is transferred to the print medium (140).

The photo-imaging cylinder (105) continues to rotate and brings the portion of the cylinder surface which previously held the ink image into a cleaning station (135). The cleaning station (135) serves multiple purposes, including cleaning any stray particulates or fluids from the photo-imaging cylinder (105) and cooling the outer surface of the photo-imaging cylinder (105). The creation, transfer, and cleaning of the photo-imaging cylinder (105) is a continuous process, with hundreds of images being created and transferred per minute.

To form a single color image (such as a black and white image), one pass of the print medium (140) through the impression cylinder (130) and blanket cylinder (120) completes the desired image. For a color image, the print medium (140) is retained on the impression cylinder (130) and makes multiple contacts with the blanket cylinder (120). At each contact, an additional color plane may be placed on the print medium (140).

For example, to generate a four color image, the photo charging unit (110) forms a second pattern on the photo-imaging cylinder (105) which receives the second ink color from a second binary ink developer (115). As described above, this second ink pattern is transferred to the blanket cylinder (120) and impressed onto the print medium (140) as it continues to rotate with the impression cylinder (130). This continues until the desired image with all four color planes is formed on the substrate. Following the complete formation of the desired image on the print medium (140), the print medium (140) can exit the machine or be duplexed to create a second image on the opposite surface of the print medium (140).

The advantages of the illustrative digital offset LEP system described above include consistent dot gain, optical densities, and colors. Because the printing system is digital, the operator can change the image being printed at any time and without any reconfiguration. Further, the printing system produces uniform image gloss, a broad range of ink colors, compatibility with a wide variety of substrate types, and rapid image drying.

Figure 2:
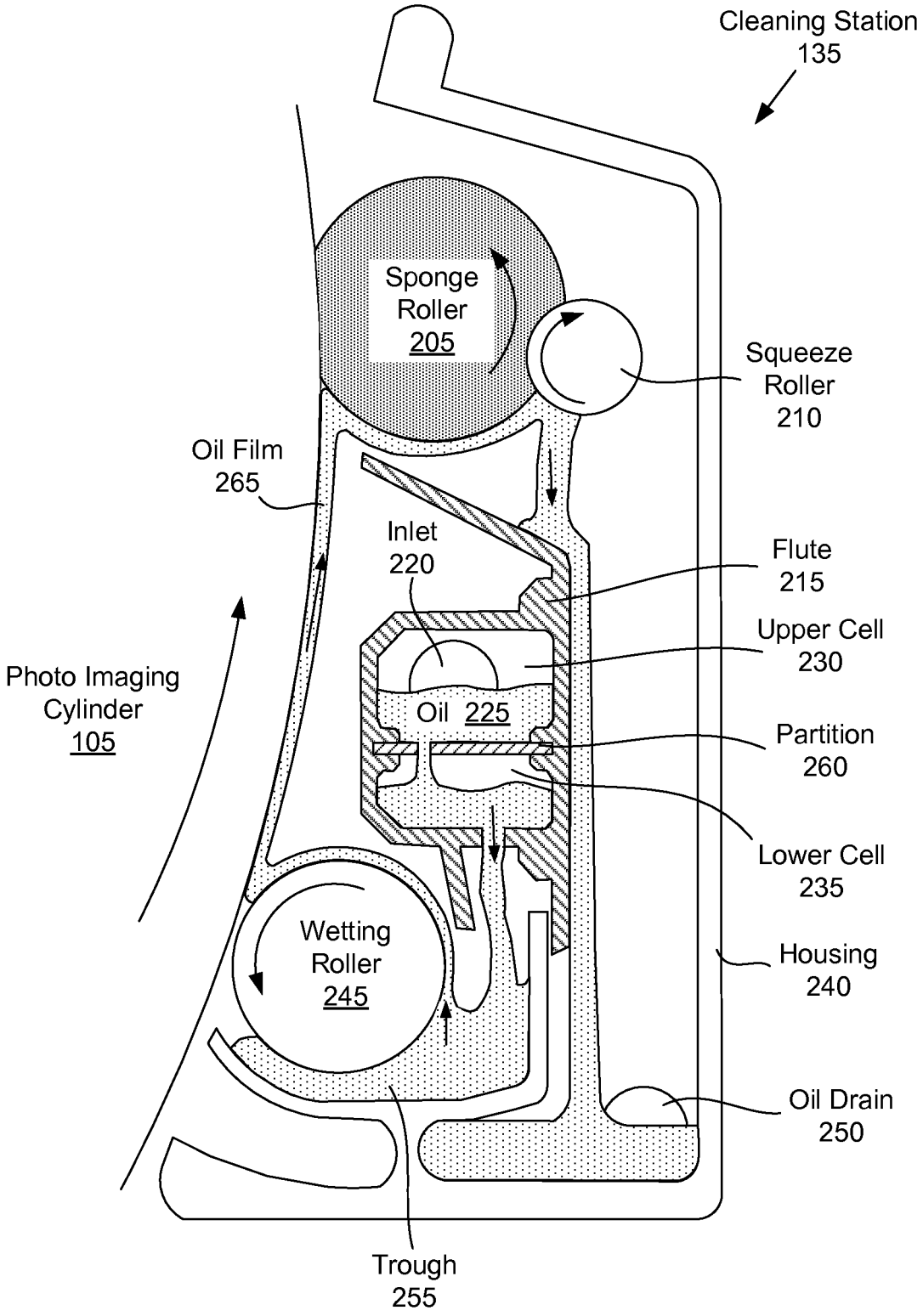
FIG. 2 is a diagram of an illustrative cleaning station, according to one embodiment of principles described herein.

FIG. 2 shows one illustrative embodiment of the cleaning station (135). As discussed above, the cleaning station (135) performs several important roles in the digital LEP system (100, FIG. 1). The cleaning station (135) removes stray ink particles and other particulates that could otherwise be incorporated into subsequent images. If the stray ink particles are transferred into subsequent images, they could result in undesirable visual artifacts.

The cleaning station (135) also cools the surface of the photo-imaging cylinder (105). The photo-imaging cylinder (105) is heated during a number of operations in the printing process. For example, the charging and laser writing of the image on the photo-imaging cylinder surface produce heat. In some illustrative embodiments, the blanket cylinder (120, FIG. 1) is heated to improve the transfer and sealing of the ink to the print medium (140, FIG. 1).

To clean and cool the photo-imaging cylinder (105), the cleaning station (135) deposits a film of cool cleaning oil (265) onto the photo-imaging cylinder surface using a wetting roller (245). This film of cleaning oil (265) cools the surface and loosens any particles which may adhere to the surface. A sponge roller (205) then scrubs away any such particles and lifts the majority of the oil film (265) from the surface of the photo-imaging cylinder (105).

According to one illustrative embodiment, the cleaning station (135) includes a housing (240) and a flute (215). The housing (240) is the exterior structural element of the cleaning station (135), and the flute (215) is an interior structural element that controls the distribution of the cleaning oil (225) to the wetting roller (245). As used in the specification and appended claims, the term "flute" refers to a long, hollow structure which accepts an input of cleaning oil and distributes the oil into a trough along the bottom of the structure.

In one embodiment, the flute (215) includes an upper cell (230) and a lower cell (235) that are separated by a partition (260). The cleaning oil (225) enters the flute (215) through an inlet (220) in the upper cell (230). The oil (225) then passes down through holes or slits in the partition (260) into the lower cell (235). From the lower cell (235), the oil (225) drops into a trough (255).

The wetting roller (245) picks up a small amount of oil from the trough (225) to create an oil film (265) to be transferred to the photo-imaging cylinder (105). The wetting roller (245) continues to rotate so as to transport the oil film (265) out of the trough (255). In some embodiments, the wetting roller (245) rotates through an angle as large as 120 to 180 degrees before depositing the oil on the photo-imaging cylinder (105).

According to one illustrative embodiment, the oil film (265) is deposited on the photo-imaging cylinder (105) using a reverse roller configuration. In a reverse roller configuration, the wetting roller (245) and the photo-imaging cylinder (105) surfaces pass each other traveling in opposite directions. In FIG. 2, the photo-imaging cylinder (105) and wetting roller (245) are illustrated as rotating counter clockwise. The cylinder (105) and roller (245) may be placed so that their surfaces are very close to each other with a separation on the order of tens or hundreds of microns. Consequently, the passage of the photo-imaging cylinder (105) surface shears the oil film (265) from the wetting roller (245). This oil film (265) adheres to the photo-imaging cylinder (105) and is transported with the surface of the cylinder (105).

Next, the surface of the photo-imaging cylinder (105) contacts the sponger roller (205). A large portion of the oil film (265) is picked up by the sponge roller (205) which also operates in a reverse roller configuration with respect to the rotation of the photo-imaging cylinder (105). The sponge roller (205) also scrubs the surface of the photo-imaging cylinder (105) to loosen and remove any stray particles. According to one illustrative embodiment, the sponge roller (205) is made from a resilient and deformable material. The sponge roller (205) is placed so that it deforms when contacting the photo imaging cylinder (105), thereby providing additional scrubbing action.

Excess oil is removed from the sponge roller (305) by a squeeze roller (210). The squeeze roller (210) is placed so that it compresses the sponge roller (205) and squeezes the oil from the pores within the sponge roller (205). The oil which is squeezed from sponge roller (205) flows through a channel between the back of the flute (215) and the housing (240) to an oil drain (250). The oil is then cooled, filtered, and recycled back into the cleaning unit (135).

As noted above, the oil film (265) should be very uniform across the surface of the photo-imaging cylinder (105). Spatial or temporal variations in the film thickness can result in uneven cooling and cleaning of the cylinder surface. This, in turn, can produce variations in print quality. For example, higher temperature areas of the photo-imaging cylinder surface may react differently than cooler areas during photocharging, ink deposition, or transfer of the ink image. Further, areas of the surface that receive less oil may retain stray ink particles from the previous image.

It has been discovered by the inventors listed herein that several factors contribute to variations in the oil film (265) thickness. First, the level of the oil (225) in the trough (255) can vary because of kinetic energy of the incoming flow of oil, variations in pump performance, and variations in the return flow of oil. Consequently, the wetting roller (245) may pick up more or less oil (225) depending on the oil (225) level in the trough (255).

Figure 3:
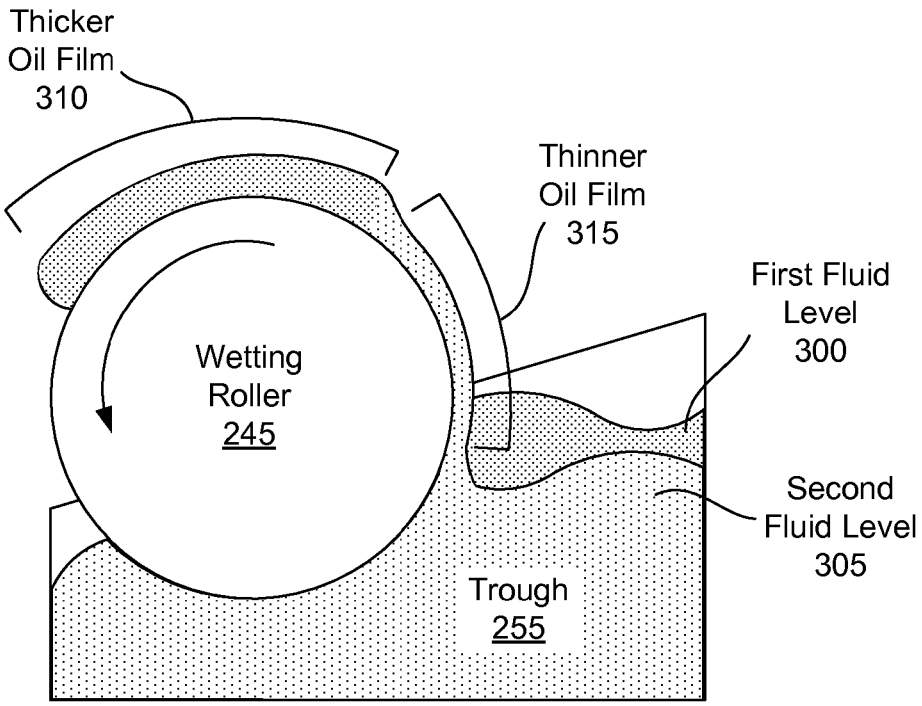
FIG. 3 is a diagram of an illustrative wetting roller operating in a trough with varying oil levels, according to one embodiment of principles described herein.

FIG. 3 is a diagram of an illustrative trough (255) and wetting roller (245). The trough (255) has a first oil level (300) at a first time and a second oil level (305) at a second time. In FIG. 3, the first oil level (300) is illustrated as being higher at the point it contacts the wetting roller (245) than the second oil level (305). As noted above, this difference in the oil level (300, 305) may result from, for example, a temporary increase in incoming oil flow rate, turbulence in the oil flow, sloshing in the trough (255) caused by the kinetic energy of the incoming oil, and other factors.

The first oil level (300) can result in the wetting roller (245) picking up a relatively thicker oil film (310), while the second and lower oil level (305) may result in a relatively thinner oil film (315) on the wetting roller (245). In general, temporal or spatial variations in the level or kinetic motion of the oil in the trough (255) can produce corresponding variations in the oil film picked up by the wetting roller (245).

Figure 4:
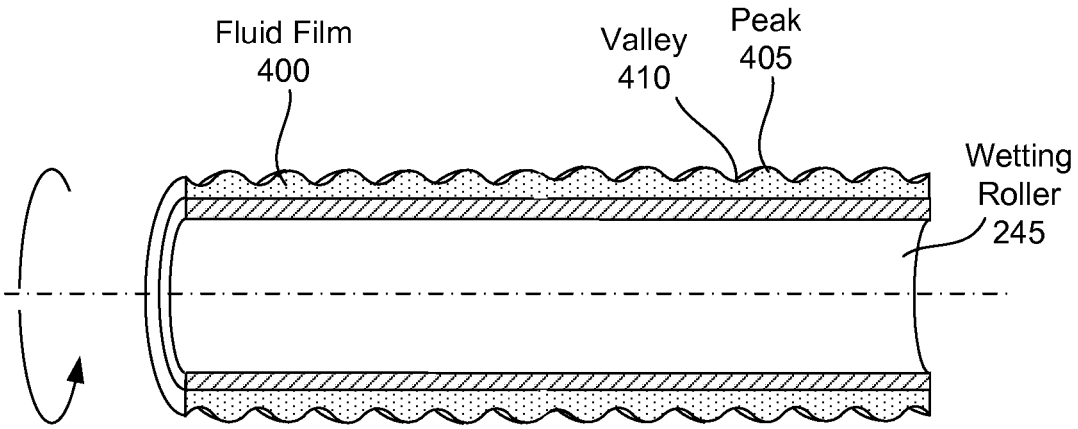
FIG. 4 is a cross-sectional view of an illustrative oil film which exhibits surface ribbing, according to one embodiment of principles described herein.

A second problem is distortion of the oil film on the wetting roller as a result of inertial and surface tension effects. FIG. 4 is a diagram showing illustrative ribbing on a wetting roller (245). An oil film (400) on the outer surface of the wetting roller (245) is ribbed with a number of peaks (405) and valleys (410) which ring the circumference of the wetting roller (245). When a rotating wetting roller picks (245) up an oil layer (310, 315), the oil experiences inertial effects, such as centrifugal forces, which tend to lift the oil from the surface of the wetting roller (245). The surface tension of the oil tends to adhere the oil to itself and to the wetting roller (245). At higher speeds, these two competing forces can create the illustrated uneven distribution of the oil. This distribution of oil is called "ribbing". Ribbing is made up of peaks (405) and valleys (410) of oil which form around the circumference of the rotating wetting roller (245). The extent of the ribbing may be influenced by a number of factors, including the oil's properties, the rotational velocity of the roller, the diameter of the roller, and other factors.

These ribs are undesirable variations in the thickness of the oil film (400) and can reduce print quality for the reasons noted above. At high enough rotational speeds, the surface tension can be overcome and oil from the peaks (405) of the ribs may be sprayed outward as droplets causing further undesirable issues. The ribbing effect can be eliminated by operating at low rotational velocities. However, this can result in the undesirable reduction in process speeds and printing throughput.

Figure 5:
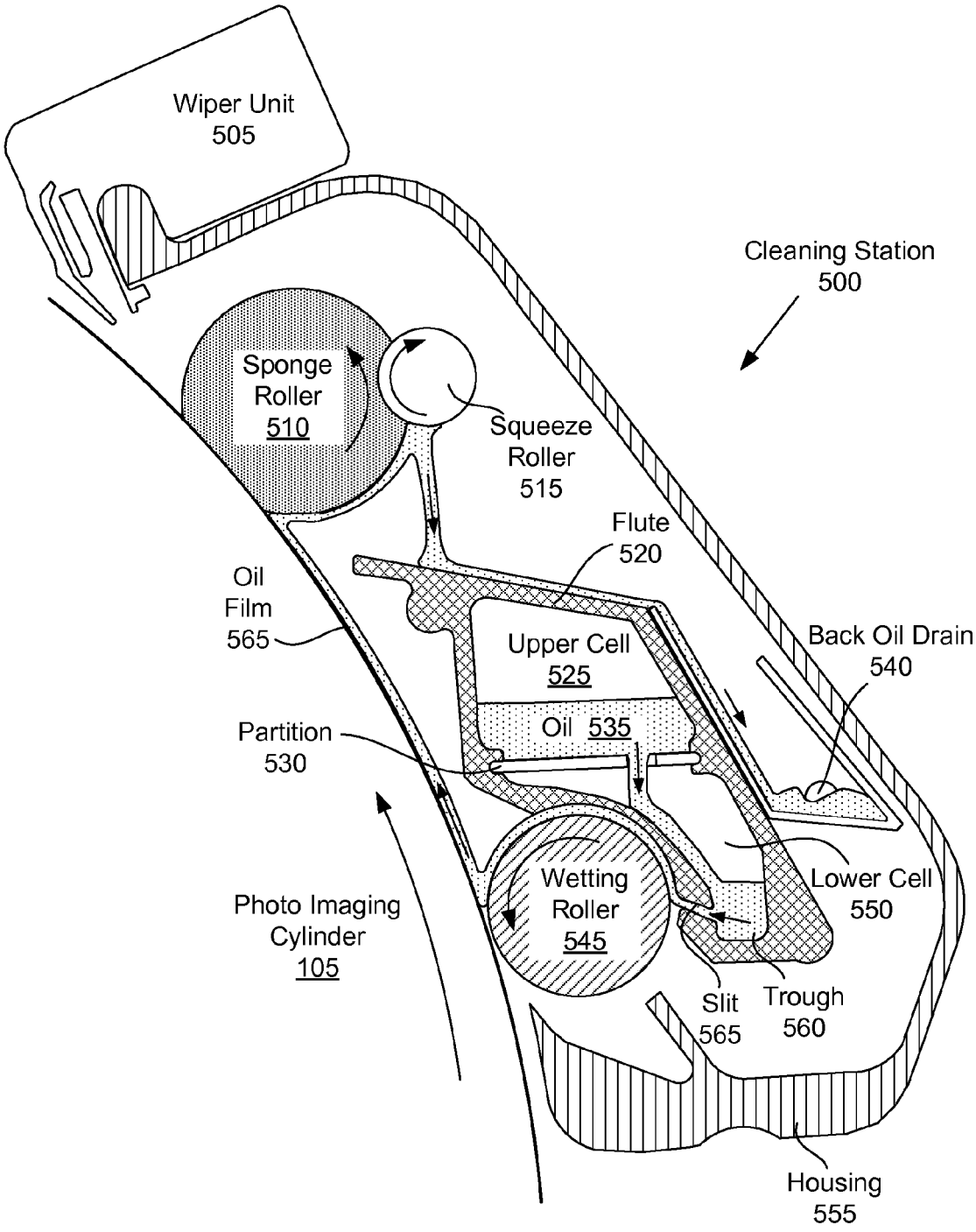
FIG. 5 is a cross-sectional diagram of an illustrative cleaning station, according to one embodiment of principles described herein.

FIG. 5 is a cross-sectional diagram of a second illustrative embodiment of a cleaning station (500). Similar to the previously described cleaning station (135, FIG. 2), this illustrative embodiment includes a housing (555) and a flute (520). Cool, clean oil (535) is introduced into the upper cell (525) of the flute (520). Unlike the previous embodiments, the upper cell (525) includes a number of baffles to remove the directionality and kinetic energy from the incoming oil flow. These baffles will be illustrated and described in more detail below.

After passing through the baffled upper cell (525), the oil (535) passes through a number of holes or slits in the partition (530) into the lower cell (550). The oil (535) drops a short distance onto an inclined inner surface of the flute (520) and into the trough portion (560) of the lower cell (550). The distance that the oil (535) free falls after passing through the partition (530) may be minimized to reduce the kinetic energy and turbulence of the oil (535) in the trough (560).

Additionally, rather than have the wetting roller (545) submerged in the trough (560), the wetting roller (545) draws the oil from the trough (560) through a slit (565). The slit (565) partially isolates the wetting roller (545) from undesirable variations, such as changes in oil levels in the trough (560) and kinematic motion of the oil (535) entering the trough (560).

The rotation of the wetting roller (545) in a cylindrical depression in the flute (520) forms a fluid pump which creates low pressure at one end of the slit (565). Oil is drawn into the slit (565) as the wetting roller (545) carries oil away from the opposite side of the slit (565).

The wetting roller (545) then moves the oil (535) through a channel (700) between the flute (520) and wetting roller (545). As the oil (535) nears the photo-imaging cylinder (105) surface, the channel (700) ends and the oil forms an oil film (565) on the wetting roller (545) with one free air surface. The wetting roller (545) rotates through a small angle and deposits the oil film (565) onto the photo-imaging cylinder (105) using the reverse roller configuration. The passage of the photo-imaging cylinder (105) surface shears the oil film (565) from the wetting roller (545) and transports the film with the surface of the photo-imaging cylinder.

As noted above, a large portion of the oil film (565) is picked up by the sponge roller (510) which also operates in a reverse roller configuration. The sponge roller (510) also scrubs the surface of the photo-imaging cylinder (105) to loosen and pick up stray particles. Excess oil is removed from the sponge roller (510) by a squeeze roller (515). The oil which is squeezed from sponge roller (515) flows over the top and back of the flute (520) and into a back oil drain (540). According to one illustrative embodiment, a wiper unit (505) includes a blade which removes a portion of the oil and contaminants which are missed by the sponge roller (510).

In the illustrated cleaning station, the vicious pumping action of the wetting roller (545) becomes the most significant force influencing the motion of the oil (535) onto the wetting roller (545). Consequently, variations in oil level within the trough (560) and the kinematic motion of the oil have much less undesirable influence on the thickness of the oil film. Instead, the thickness of the film can be primarily determined by more controllable parameters such as the rotational velocity of the wetting roller (545) and the size of the channel (700).

Figure 6:
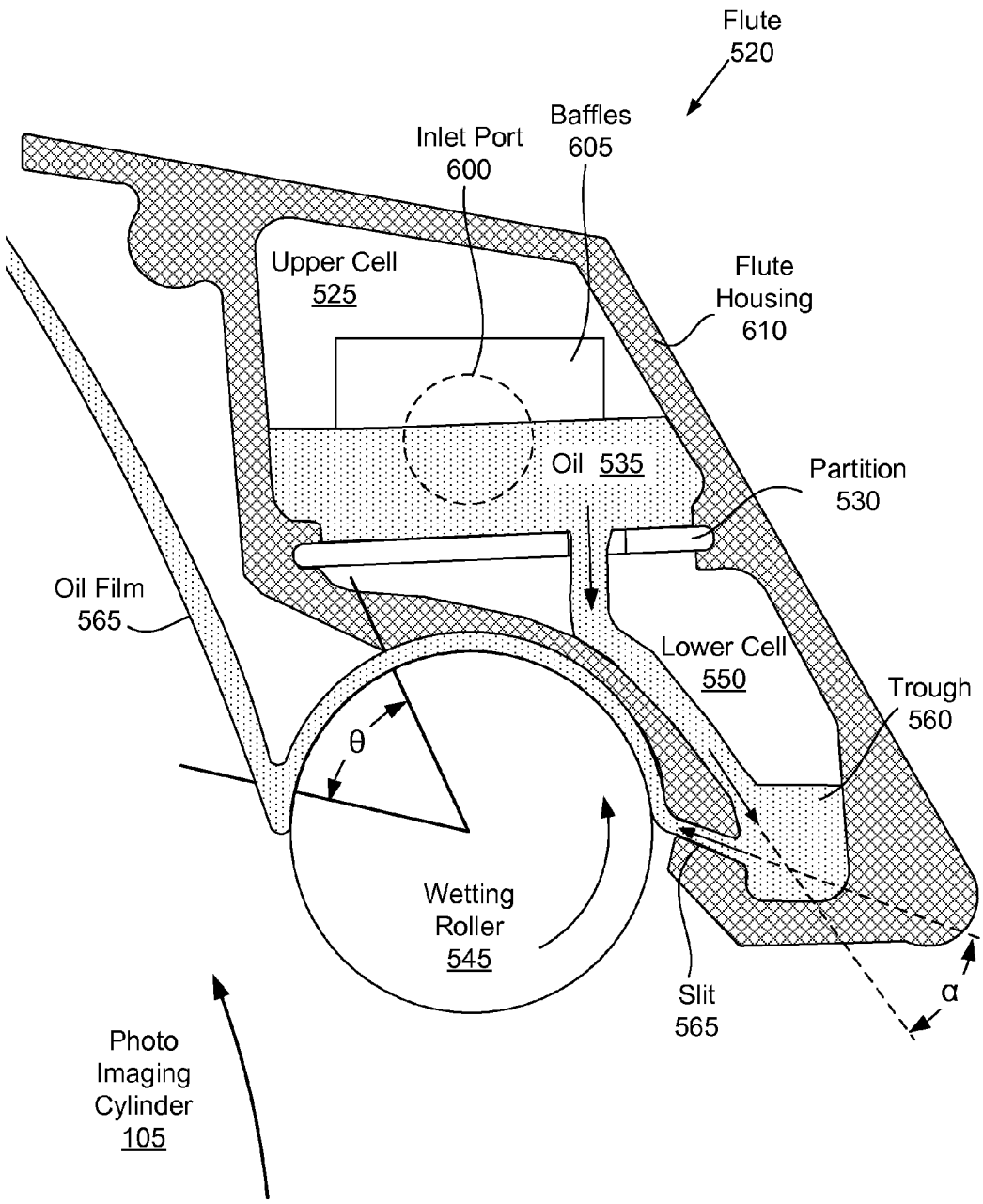
FIG. 6 is a cross-sectional diagram of a flute and wetting roller dispensing an oil film onto a photo-imaging cylinder, according to one embodiment of principles described herein.

FIG. 6 is an enlarged cross-sectional diagram of the flute (520), wetting roller (545) and a portion of the photo-imaging cylinder (105). A number of parameters which were discussed above are shown in more detail in FIG. 6. The upper cell (525) includes an inlet port (600) and baffles (605). The baffles (605) reduce the directionality of the incoming oil flow and distribute the oil (535) more uniformly across the length of the flute (520). As discussed above, the oil (535) then passes through a number of holes or slits in the partition (530) into the lower cell (550). The free fall of the oil (535) after passing through the partition is minimized by introducing a sloping wall of the flute housing (610).

The oil (535) passes down the sloping wall and enters the trough (560) at an entry vector. The oil (535) leaves the trough (560) through the slit (565) at an exit vector. The fluid vector angle $\alpha$ is the angle between the entry vector and the exit vector. By reducing the fluid vector angle $\alpha$, the kinetic energy of the incoming oil flow is directed away from the slit (565) and less directly influences the exiting flow. According to one illustrative embodiment, the fluid vector angle $\alpha$ is less than 90 degrees. In another illustrative embodiment, the fluid vector angle $\alpha$ is less than 45 degrees.

As discussed above, the viscous pumping action of the roller (545) draws the oil (535) through the slit (565). The rotational velocity of the wetting roller (545) and the size of the channel (700) directly influence the flow rate of the oil (535) and the thickness of the film. As the oil (535) nears the surface of the photo-imaging cylinder (105), the channel (700) ends and the oil (535) forms an oil film (565) with one free air surface.

As discussed above with respect to FIG. 4, ribbing or other inertial effects may disrupt the uniformity of an initially uniform oil film (565) on the outer surface of the wetting roller (545). These inertial effects can be reduced or eliminated by slowing the rotation of the wetting roller (545) below the threshold where inertial forces cause ribbing. However, slowing the rotation of the wetting roller (545) could result in an undesirable reduction in the amount of oil dispensed onto the surface of the photo-imaging cylinder (105). Consequently, the rotation of the photo-imaging cylinder (105) would need to be slowed and the throughput of the printer reduced.

However, another method of preventing ribbing has been discovered by the inventors listed herein that would allow the operation of the wetting roller (545) at speeds significantly greater than the inertial threshold for ribbing. By substantially reducing the angle through which the upper surface of the oil film (565) is exposed to the free air, the oil film (565) can be deposited on the photo-imaging cylinder (105) before the ribbing in the oil film (565) has an opportunity to form. Once the oil film (565) is deposited on the photo-imaging cylinder (105), the inertial forces are substantially less because of the greater diameter of the photo-imaging cylinder (105).

The formation and operation of the channel (700) will now be described in more detail. As shown in FIG. 6, the free air angle $\theta$ describes the angle through which the wetting roller (545) carries the oil film (565) with a free air surface. The free air angle $\theta$ is reduced or minimized by the extent of the channel (700). The channel (700) is formed by creating a cylindrical shaped cavity in the flute housing (610) and positioning the wetting roller (545) in the cavity such that the channel (700) is provided between the housing (610) and the wetting roller (545). As shown, this channel (700) extends from the slit (565) around a significant portion of the wetting roller (545).

While the oil (535) on the wetting roller (545) is moving through the channel (700), it has no free surface and ribbing cannot develop. Shortly before the oil (535) is deposited onto the photo-imaging cylinder (105), beyond the flute housing (610), the channel (700) ends, and the oil film (565) on the wetting roller (545) is exposed to air. As shown in FIG. 6, the free air angle $\theta$ is measured from the channel exit to the point where the oil film (565) makes contact with the photo-imaging cylinder (105). The oil film travels through the relatively small free air angle $\theta$ and is deposited on the photo-imaging cylinder (105) before ribbing can develop. Minimization of the free air angle $\theta$ allows the wetting roller (545) to operate at an angular velocity which exceeds the threshold at which ribbing features would ordinarily form. According to one illustrative embodiment, the free air angle $\theta$ is less than 90 degrees. In another embodiment, the free air angle $\theta$ is less than 45 degrees.

Figure 7:
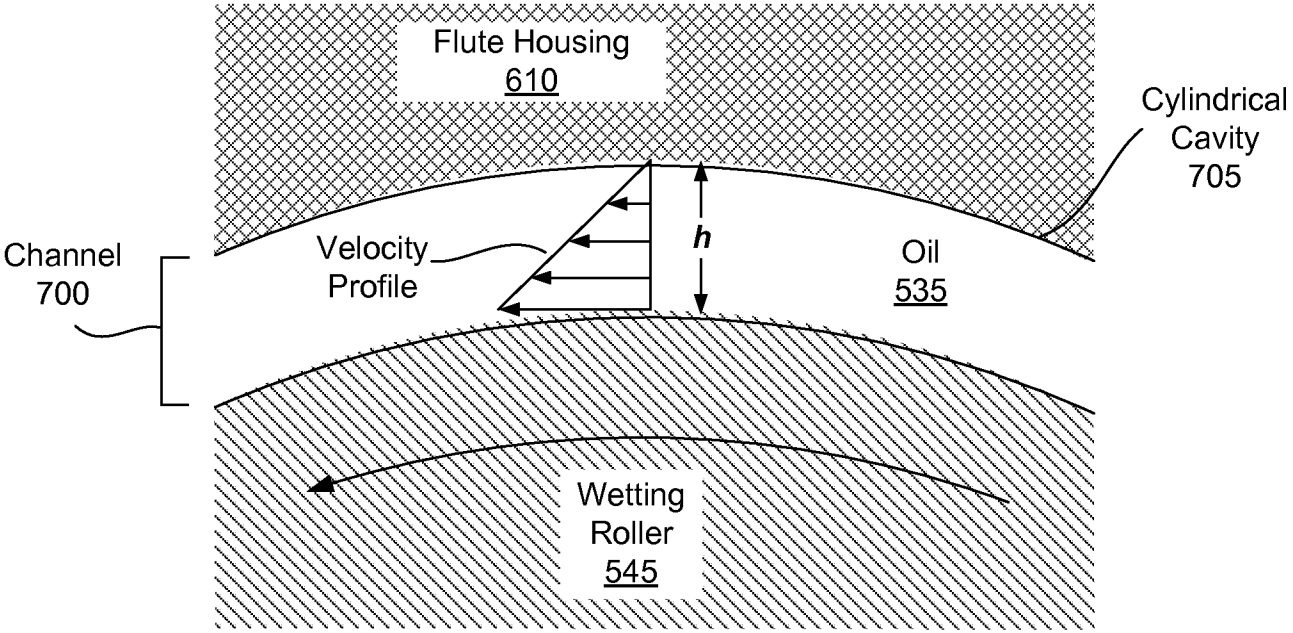
FIG. 7 is a cross-sectional diagram of a channel formed by a flute housing and a wetting roller, according to one embodiment of principles described herein.

FIG. 7 is an enlarged cross-sectional view of the channel (700) between the wetting roller (545) and the cylindrical cavity (705) in the flute housing (610). According to one illustrative embodiment, the channel (700) has a uniform height h. The flute housing (610) is stationary and the surface of the wetting roller (545) moves with a velocity v. The velocity profile (705) can then be approximated from these boundary conditions. The oil in contact with the flute housing (610) is stationary, and the oil directly in contact with the wetting roller (545) is moving at the velocity v. Assuming uniform shear through the height h the velocity profile (705) of the oil (535) can be represented as a triangle, which is shown in FIG. 7. Consequently, the average velocity of the oil (535) is v/2, which is half the velocity of the wetting roller (545).

The mass flow rate of the oil (535) can then be calculated using the average velocity of the oil (535), the height h and the axial length of the roller (545). The height h and length of the roller (545) are fixed by the geometric shapes of the flute housing (610) and the roller (545). The only remaining variable is the rotational speed of the wetting roller (545), which can be precisely controlled to deliver the desired amount of oil (535) to the photo-imaging cylinder (105, FIG. 6).

In addition to increase precision in delivering the oil (535), this arrangement provides increased flexibility in optimizing the printing system operation. If an increase or decrease in the mass flow rate of oil (535) is desired, a simple calculation can be performed to determine the speed at which the wetting roller (545) should be turned to deliver the desired mass flow rate of oil (535). For example, if an increase in process speed is desired, the required wetting roller velocity can be calculated to deliver the optimum amount of cooling and cleaning oil (535).

Figure 8:
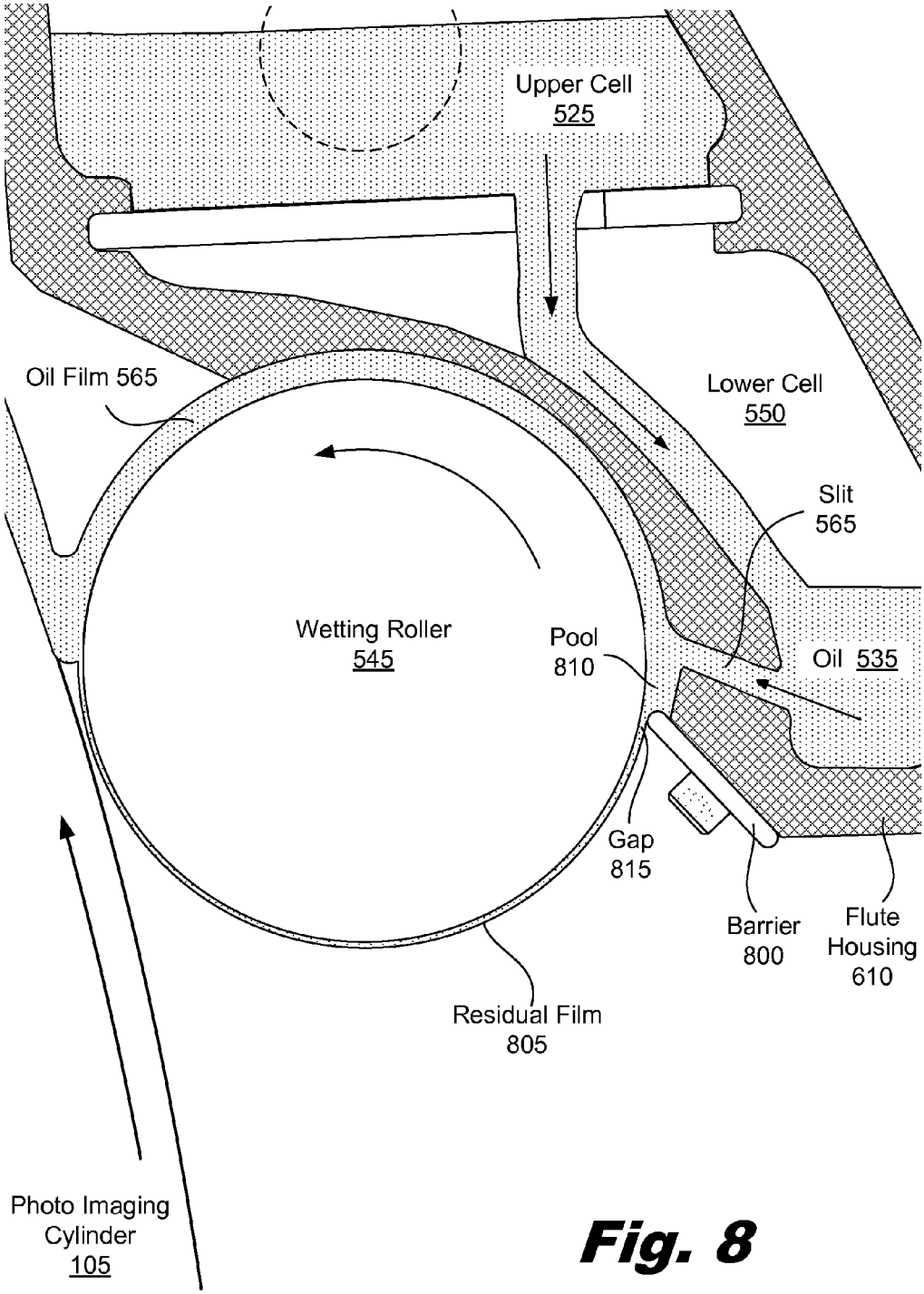
FIG. 8 is a diagram of an illustrative inlet baffle arrangement, according to one embodiment of principles described herein.

FIG. 8 is a diagram which shows an illustrative barrier (800) that is attached to the flute housing (610). According to one illustrative embodiment, the barrier (800) controls the formation of the meniscus under the oil flow as it exits the slit (565) and is picked up by the wetting roller (545).

An uncontrolled meniscus under the oil flow can lead to several issues. First, the meniscus can separate into bubbles that are pulled into the oil film (565). These bubbles can disrupt the homogeneity of the oil film (565). Additionally, when the meniscus breaks, oil can be lost by flowing downward instead of being incorporated into the oil film (565). This can lead to a reduction in the efficiency of the cleaning station. In some embodiments, the rupture of the meniscus can also lead to a variation in the film thickness as a portion of the oil (535) escapes downward.

A barrier (800) which is positioned so that there is a controlled gap (815) between the tip of the barrier (800) and the rotating surface of the wetting roller (545) is surprisingly effective in controlling the meniscus and increasing the overall efficiency of the cleaning station. With the barrier in place, the oil (535) fills the space above the barrier (800) to form a pool (810). A stable meniscus is then formed in the relatively small gap between the barrier (800) and the wetting roller (545). The barrier (800) provides better control over the meniscus and can reduce the likelihood that the meniscus will rupture or otherwise disrupt the oil flow.

Several considerations can influence the placement of the barrier and the resulting gap (815) width. A first consideration may be that the gap (815) should be wide enough that the wetting roller (545) can rotate without impediment.

A second consideration may be that the gap (815) should be small enough to be effective in controlling the meniscus. According to one illustrative embodiment, the gap (815) is half the width of the slit (565) or less. In one embodiment, the gap distance may be less than 500 microns. In another illustrative embodiment, the gap distance may be between 300 microns and 50 microns.

A third consideration may be accommodating a residual oil film (805). When the oil film (565) is sheared off the wetting cylinder (545) by the photo-imaging cylinder (105), a small amount of residual oil (805) can remain on the wetting roller (545). According to one illustrative embodiment, the gap (815) is sufficiently large enough to allow this residual oil film (805) to pass by the barrier (800) and be reintroduced into the pool (810). This improves the efficiency of the cleaning station. The residual oil film (805) may also form a liquid seal in the gap (815), which reduces the entry of air into the gap (815).

Figure 9:
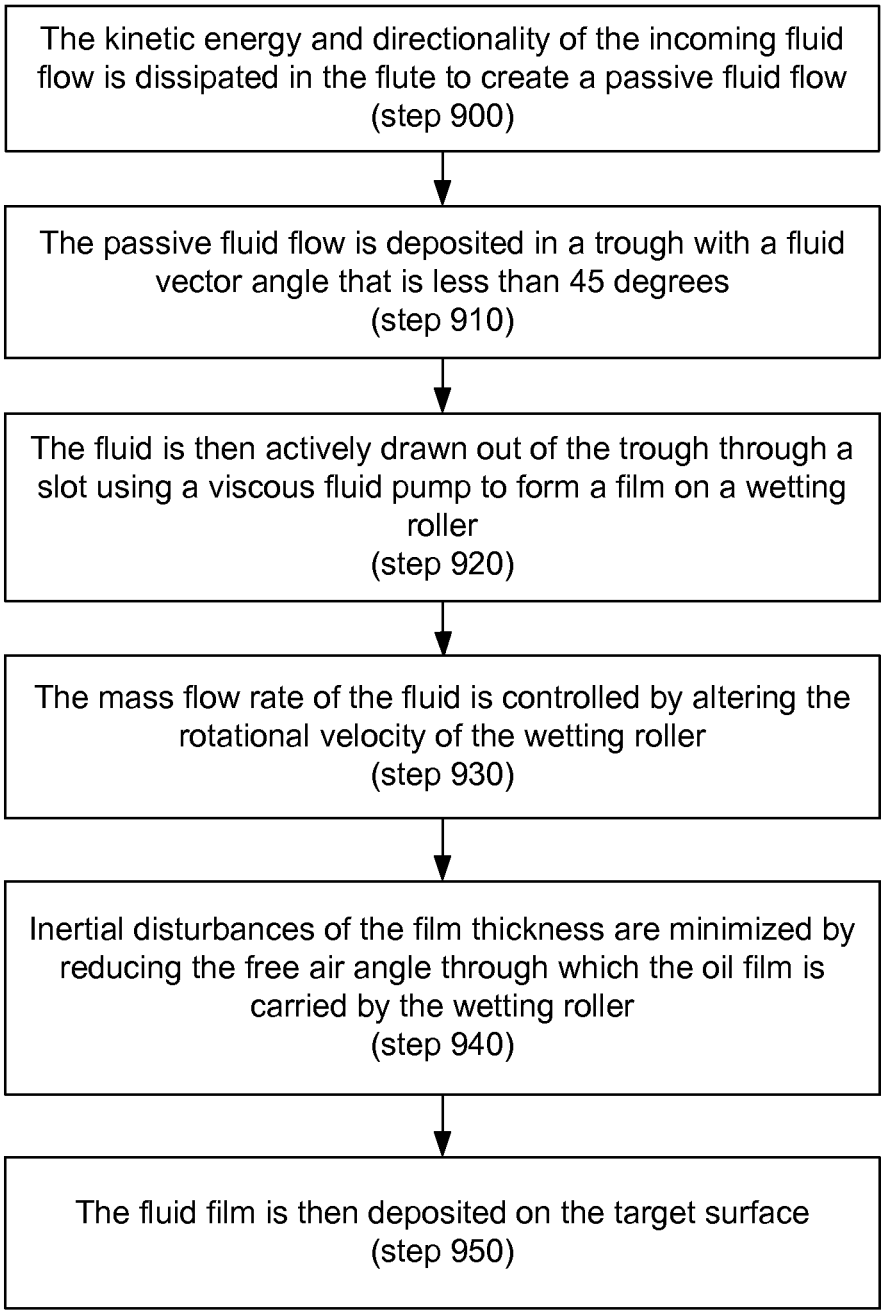
FIG. 9 is a flowchart showing an illustrative method for dispensing a high precision oil film, according to one embodiment of principles described herein.

FIG. 9 is a flow chart of one illustrative method for creating a high precision oil film. In a first step, the kinetic energy and directionality of an input flow are dissipated (step 900). According to one illustrative embodiment, a number of baffles, holes, slits, channels, chambers, and other features can be used turn the kinetic oil flow into a passive oil flow. The oil flow is then deposited into a trough or reservoir such that the fluid vector angle is less than 45 degrees and the kinetic energy of the incoming oil flow does not directly impinge or produce substantial pressure variation at the exit (step 910). The oil is then actively drawn out of the trough through a slit (step 920). According to one illustrative embodiment, the oil is drawn out of the slit using a viscous pump which is made up of a wetting roller rotating in a cylindrical cavity. The gap between the cylindrical cavity and the wetting roller form a channel into which the oil is drawn. This channel extends around a portion of the wetting roller.

The mass flow rate of the oil is controlled by altering the rotational velocity of the wetting roller (step 930). According to one illustrative embodiment, the mass flow rate is proportional to a constant times one half the velocity of the surface of the wetting roller.

Inertial disturbances of the film thickness are minimized by reducing the free air angle through which the oil film is carried by the wetting roller (step 940) after exiting the channel. According to one illustrative embodiment, the channel extends a significant distance around the wetting roller to minimize the free air angle. In one illustrative embodiment, the free air angle may be less than 90 degrees. In another illustrative embodiment, the free air angle may be less than 45 degrees. The oil film is then deposited on the target surface (step 950). According to one illustrative embodiment, the target surface is a photo-imaging cylinder within a digital LEP system. The oil film can be deposited in a number ways, including, but not limited to, a reverse roller configuration.

In sum, a cleaning station controls the thickness of the film which is deposited on the photo-imaging cylinder. By creating a passive flow and then introducing it into a trough, undesirable variations in the energy, motion, and levels of the oil within the trough can be avoided. A viscous pump formed by the rotation of the wetting roller in a cylindrical cavity pulls the oil in the trough through a slit and onto the surface of the wetting roller. The viscous pump creates a method of precisely controlling the amount of oil dispensed and the thickness of the oil film. This viscous pump extends around the wetting roller and limits the free air angle through which the oil film is exposed. This reduces inertial artifacts produced in the free surface of the film by reducing the time available for the formation of the artifacts. The result is the deposition of an oil film on the photo-imaging cylinder which is flat and accurate in thickness.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A method for creating a cleaning fluid film on a photo-imaging cylinder comprising:

introducing a passive fluid flow into a trough;

pumping said fluid out of said trough using a viscous pump, said viscous pump comprising a wetting roller rotating within a cavity, a fluid film being formed on said wetting roller; and depositing said fluid film on said photo-imaging cylinder.

2. The method of claim 1, further comprising controlling a meniscus under said fluid film by disposing a barrier adjacent said wetting roller, a width of a gap between said barrier and wetting roller being less than half of a width of said slit.

3. The method of claim 1, further comprising controlling a flow rate of said fluid by altering a rotational velocity of said wetting roller.

4. The method of claim 1, further comprising reducing inertial disturbances in a thickness of said fluid film by reducing a free air angle to less than 90 degrees, said free air angle being a measure of a portion of said wetting roller on which a fluid film with a free air surface is present.

5. The method of claim 4, further comprising reducing said inertial disturbances in a thickness of said fluid film by reducing said free air angle to less than 45 degrees.

6. A device for performing the method of claim 1, said device comprising:

said trough for receiving said passive fluid flow;

said viscous pump for pumping said fluid out of said trough, said viscous pump comprising said wetting roller, a fluid film being formed on said welling roller during rotation of said wetting roller; and said wetting roller for depositing said fluid film on said photo-imaging cylinder.

7. A device for creating a cleaning fluid film on a photo-imaging cylinder comprising:

a trough for receiving a passive fluid flow;

a viscous pump for pumping said fluid out of said trough, said viscous pump comprising a wetting roller, a fluid film being formed on said wetting roller during rotation of said wetting roller; and said wetting roller for depositing said fluid film on said photo-imaging cylinder.

8. The device of claim 7, further comprising a flute, wherein said trough is located at a bottom portion of said flute, and wherein said viscous pump is configured to pump said fluid out of said trough through a slit in said flute.

9. The device of claim 8, wherein said flute comprises at least one of baffles, holes, slits, channels, and chambers to generate said passive fluid flow.

10. The method of claim 1, wherein said trough is located in a bottom portion of a flute and said pumping comprises pumping said fluid out of said trough through a slit in said flute using said viscous pump.

* * * * *